United States Patent [19]

DeLong

[11] 4,443,660

[45] Apr. 17, 1984

[54] SYSTEM AND METHOD FOR ENCRYPTING A VOICE SIGNAL

[75] Inventor: Vincent R. DeLong, Marion, Iowa

[73] Assignee: Rockwell International Corporation, El Segundo, Calif.

[21] Appl. No.: 347,598

[22] Filed: Feb. 10, 1982

Related U.S. Application Data

[63] Continuation of Ser. No. 118,360, Feb. 4, 1980.

[51] Int. Cl.[3] ..... H04K 1/06

[52] U.S. Cl. ..... 178/22.04; 179/1.5 R; 179/1.5 M; 179/1.5 FS

[58] Field of Search ..... 178/22.04, 22.06, 22.05; 179/1.5 R, 1.5 S, 1.5 M, 1.5 FS

[56] References Cited

U.S. PATENT DOCUMENTS

| | | | |
|---|---|---|---|
| 2,301,455 | 11/1942 | Roberts | 179/1.5 R |
| 2,411,206 | 11/1942 | Guanella | 179/1.5 R |
| 3,924,075 | 12/1975 | Gannett | 179/1.5 R |
| 3,970,790 | 7/1976 | Guanella | 178/22.04 |
| 4,100,374 | 7/1978 | Jayant et al. | 179/1.5 S |
| 4,149,035 | 4/1979 | Frutiger | 178/22.05 |
| 4,157,453 | 6/1979 | Rosen | 178/22.05 |
| 4,160,123 | 7/1979 | Guanella et al. | 179/1.5 R |
| 4,173,025 | 10/1979 | Prehn | 179/1.5 S |
| 4,188,506 | 2/1980 | Schmid et al. | 179/1.5 R |
| 4,217,469 | 8/1980 | Martelli | 179/1.5 R |
| 4,232,194 | 11/1980 | Adams | 179/1.5 R |

FOREIGN PATENT DOCUMENTS

| | | | |
|---|---|---|---|
| 7712095 | 5/1978 | Netherlands | 179/1.5 R |

*Primary Examiner*—Sal Cangialosi

*Attorney, Agent, or Firm*—V. Lawrence Sewell; H. Fredrick Hamann; Howard R. Greenberg

[57] ABSTRACT

A system and method are disclosed for encrypting a voice signal. The input signal is filtered to provide a signal in a first path with components in a higher frequency band and a signal in a second path with components in a lower frequency band. Analog-to-digital conversion is carried out at a rate such that the frequency composition of the higher frequency path is inverted and shifted into the lower frequency band. Signals from the two paths are intermixed and converted to analog form at a rate greater than twice the rate of analog-to-digital conversion, so as to provide a randomized sequence of time segments of signals from the two paths, interspersed with gaps.

18 Claims, 9 Drawing Figures

SYSTEM AND METHOD FOR ENCRYPTING A VOICE SIGNAL

This application is a continuation of application Ser. No. 118,360, filed Feb. 4, 1980.

BACKGROUND OF THE INVENTION

This invention relates to time division encryption systems and methods.

Voice secrecy can be achieved by digital or analog methods. Methods which are largely digital can produce an extremely high quality encryption. Moreover, the basic encoding is relatively inexpensive. However, these digital methods require a large transmission bandwidth. As a result, if normal telephone lines are to be used, costly equipment is required, and even so good voice recognition is frequently lost in the process.

By contrast, voice secrecy systems which are largely analog can produce a scrambled signal which does not require an appreciable increase in bandwidth compared to the original voice signal. Such systems in the past have however tended to retain some residual speech character and intelligibility which rendered them relatively less secure. In addition, the operation of conventional analog voice scramblers is such that the signal is quite susceptible to degradation when sent over poor transmission lines, both as to amplitude distortion and phase delay distortion.

The present invention teaches a significant improvement of a time division encryption system and method which reduces residual intelligibility to practically zero, eliminating any voice character from the transmitted signal. Furthermore, the encryption disclosed provides an output signal which is less susceptible to distortion by a transmission line.

SUMMARY OF THE INVENTION

In accordance with the present invention, there is provided a system and method for encrypting a voice signal into a secure form suitable for transmission. The input signal is filtered to provide a signal in a first path with components in a higher frequency band and a signal in a second path with components in a lower frequency band. Analog-to-digital conversion is carried out at a rate such that the frequency composition of the higher frequency path is inverted and shifted into the lower frequency band. Signals from the two paths are intermixed and converted back to analog form at a rate greater than twice the rate of the analog-to-digital conversion, so as to provide a randomized sequence of time segments of signals from the two paths, interspersed with gaps.

The method and system of the invention provide an encoded output with an extremely low residual intelligibility by the combination of inverting the high band and folding it into the low band, intermixing signal segments from the two bands in a randomized manner and converting to analog form at a higher rate than the previous analog-to-digital conversion. The provision of gaps between the signal segments serves to reduce the susceptibility of the encrypted output to distortion by transmission lines.

Figure 3:
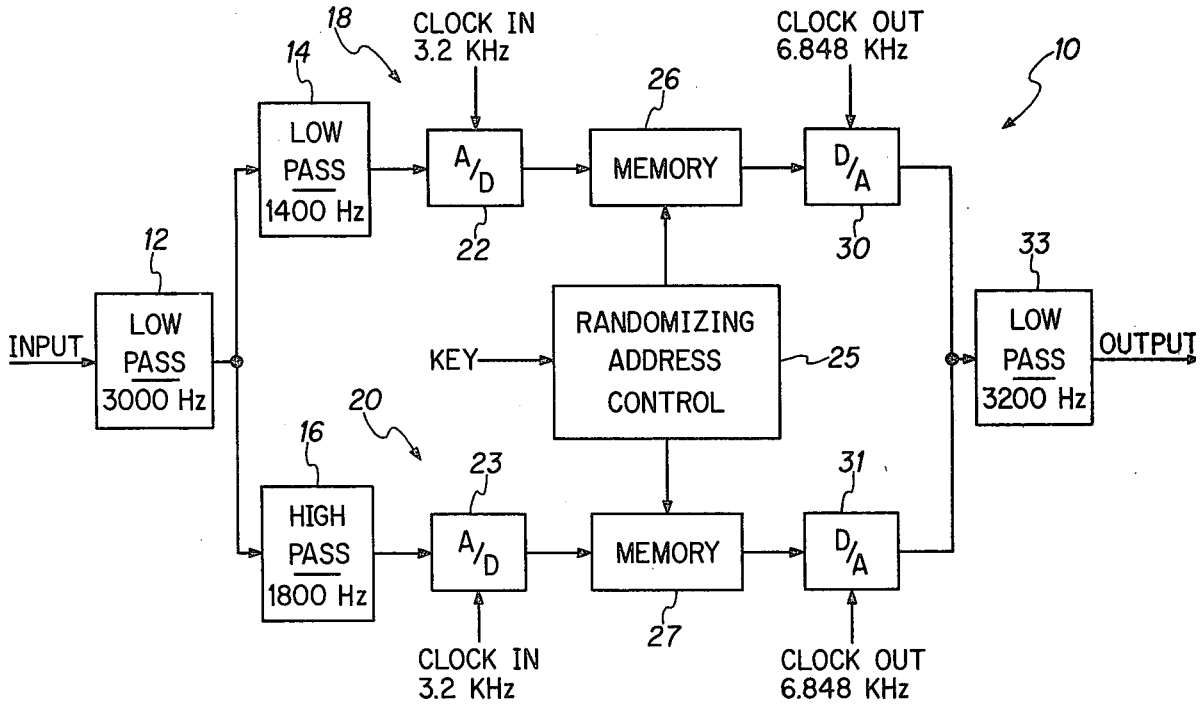
FIG. 3 shows a system and method according to the present invention.

FIGS. *4a* through *4e* are a collection of amplitude-frequency spectra for the system and method of FIG. 3.

Figure 5:
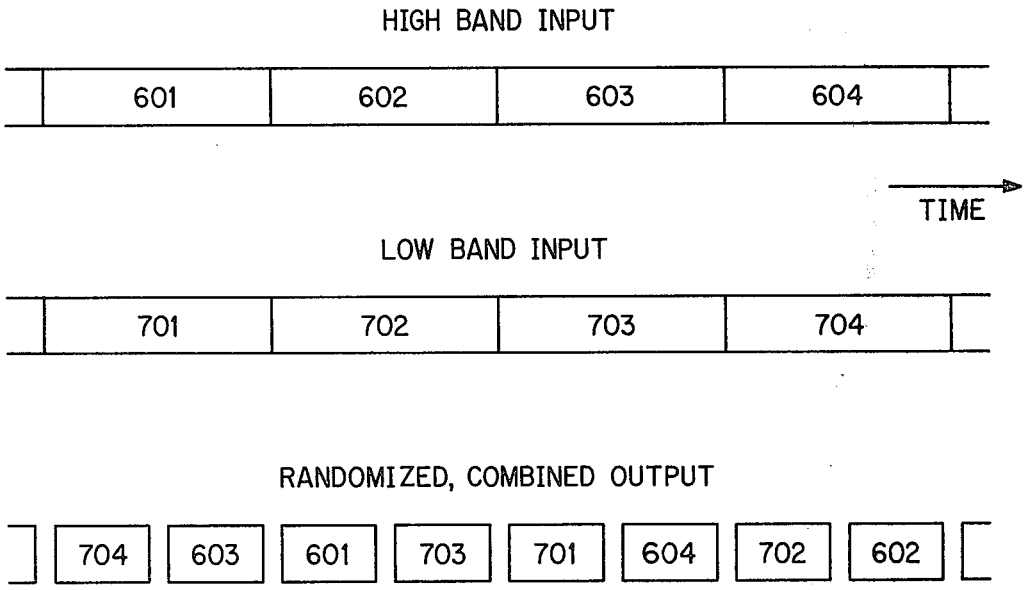

FIG. 5 illustrates randomizing time segments of signals in the system and method of FIG. 3.

DESCRIPTION OF THE PREFERRED EMBODIMENTS

Figure 1:
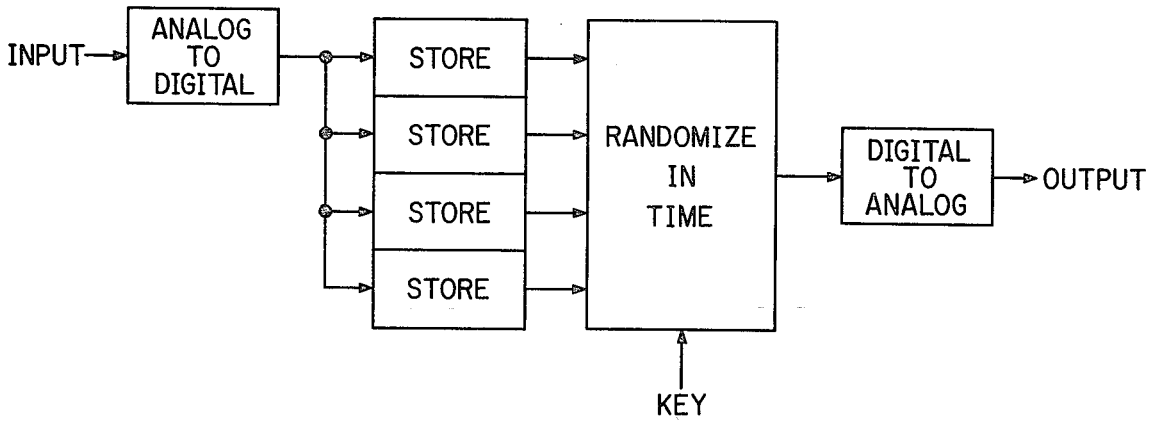
FIG. 1 PRIOR ART
FIG. 1 illustrates a system and method of encryption according to the prior art.
Figure 2:
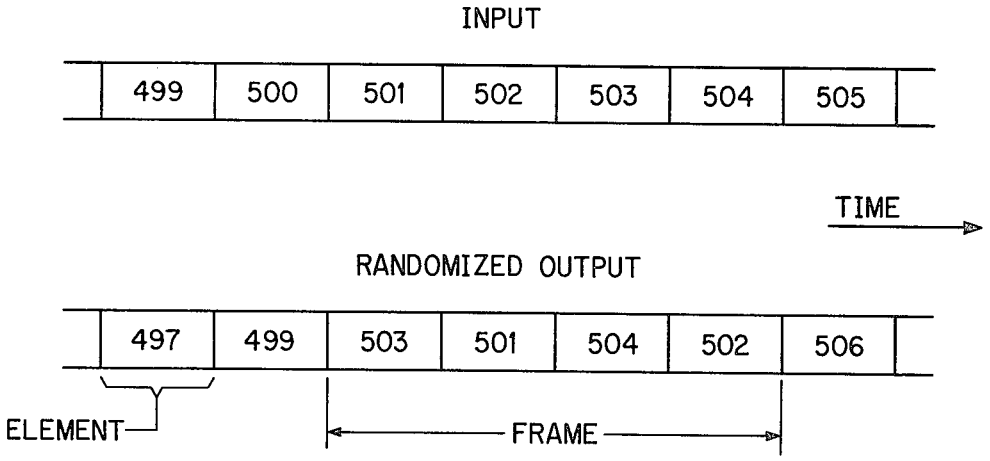
FIG. 2 PRIOR ART
FIG. 2 illustrates time randomizing of segments of input data in accordance with the prior art.

FIGS. 1 and 2 illustrate the operation of prior art circuits related to the present invention. FIG. 1 illustrates the overall functions present in a time division scrambling or encryption method and system. An analog voice signal is converted to digital form and the resulting samples are temporarily stored in a memory. The samples are read from the memory in a scrambled time sequence before they are reconverted to an analog output signal.

FIG. 2 illustrates the effect of the time division encryption of FIG. 1. In the upper part of the figure is an illustration of a time sequence of numbered segments of an analog signal, or segments of the digital samples thereof. The lower portion of the figure illustrates a randomized output in which the segments are designated "elements", and groups of elements, such as elements 501–504 form a "frame". The elements within a first frame are rearranged in a randomized order; then the elements of the next frame are rearranged in a different randomized order, and so on. The terms "random", "randomized" and the like used in this specification and claims refer to the action of a broad class of well-known high quality encryption algorithms. Such algorithms generate a sequence of random or pseudorandom numbers for a particular key number used in the encryption or encoding process. Knowing the key, the output can be decoded, generally by recreating the sequence of random numbers used in the encoding.

FIG. 3 illustrates the processing carried out in a system and method according to the present invention. The various filter and sample frequencies described herein are interrelated in ways that will become apparent. It will also be apparent however to those skilled in the art that frequencies other than those specifically shown can readily be employed in the method and system of the invention.

In the system of FIG. 3, referred to generally by the reference numeral 10, an input analog voice signal is first filtered by a low pass filter 12. Filter 12, having a cutoff frequency of 3000 Hz can, for example, be a Cauer filter. The output of low pass filter 12 is then filtered with a low pass filter 14 and a high pass filter 16 to provide first and second signal paths, referred to with reference numerals 18 and 20 respectively. Filter 14 has a cutoff frequency of 1400 Hz, while filter 16 has a lower cutoff of 1800 Hz. Both filters 14 and 16 can be Cauer filters.

FIGS. *4a* and *4b* illustrate the effect of filters 14 and 16. In FIG. *4a*, the somewhat diagrammatic amplitude spectrum shows frequency components in a band from 200–1400 Hz. The shape of the spectrum is not intended to have any significance. The 1400 Hz upper cutoff is, of course, produced by the filtering action of filter 14. The signal is not expected to contain significant content below 200 Hz. In FIG. *4b*, the high band is composed ot components between the 1800 Hz cutoff of high pass filter 16 and the 3000 Hz cutoff of low pass filter 12.

Figure 4A:
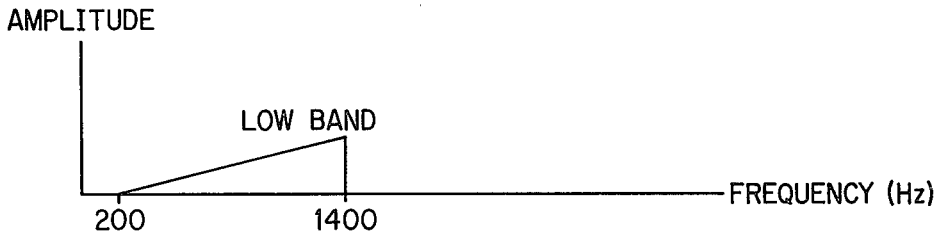
Figure 4B:
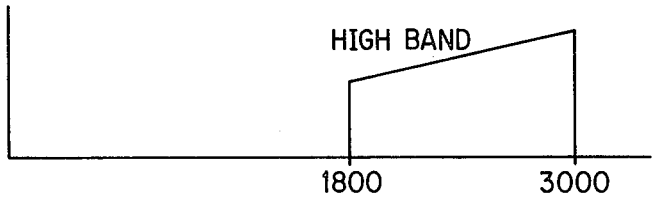
Figure 4C:
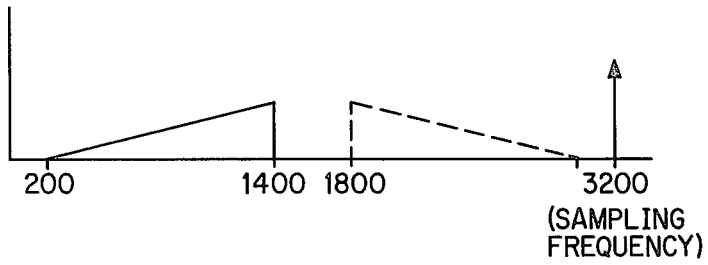
Figure 4D:
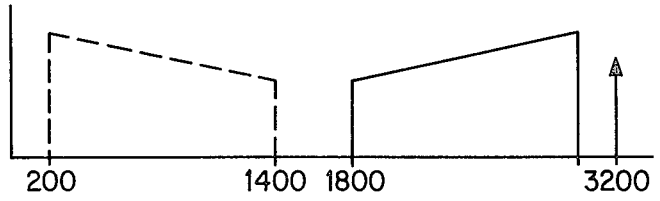

In both signal paths 18 and 20, the filtered analog signal is converted to digital form by analog-to-digital converters 22 and 23. Consistent with the other frequencies employed, this can be performed at 3200 Hz. FIG. 4*c* illustrates the effect of the sampling by analog-to-digital converter 22 on the low band signal in path 18. Aliasing due to the sampling adds an inverted version of the low band spectrum in the range 1800–3000 Hz. In FIG. 4*d*, the effect on the high band information in path 20 is seen. An inverted version of the high band spectrum is added, running from 200–1400 hertz. Because of the selection of the various frequencies in relation to each other, this is the same band occupied by the uninverted spectral content in path 18, as seen in FIG. 4*a*.

Data segments represented by the samples from analog-to-digital converters 22 and 23 are randomized in time in accordance with an encryption algorithm. The functions of randomizing address control 25 and memories 26 and 27 of FIG. 3 can be carried out by a microprocessor or other systems of the kind employed to perform the encryption illustrated in connection with FIG. 1. The randomizing function in FIG. 3 is such that the data segments represented by digital samples in the two paths 18 and 20 are to be scrambled together in an intermixed fashion. The output of the intermixing and scrambling function is preferably at a rate which is at least twice the 3200 Hz sampling rate of converters 22 and 23. In a preferred embodiment illustrated in FIG. 3, the output clock rate is higher than twice the input clock rate, so that gaps may be included between data segments in the output, as will be described further hereinafter.

Since segments of the samples from the two signal paths 18 and 20 are to be intermixed in a scrambled fashion, digital-to-analog converters 30 and 31 which provide the analog output from the randomizing process must be under the control of randomizing control 25. For example, digital-to-analog converter 30 may be active for two or more successive samples, then converter 31 is active, then back to converter 30 again. Actually, there need not be two totally physically distinct signal paths with two analog-to-digital converters and two digital-to-analog converters as shown in FIG. 3. With proper switching control, the low band paths and high band paths can be sampled, randomized and reconverted to analog form using a single analog-to-digital converter and a single digital-to-analog converter.

FIG. 5 illustrates the intermixing of data segments from the two signal paths 18 and 20 to form a randomized time sequence as shown in the lower part of FIG. 5. In a preferred embodiment, the data is clocked out of digital-to-analog converters 30 and 31 at a rate greater than twice the rate of the analog-to-digital converters 22 and 23, so that gaps may be interspersed between the output data segments, as seen in FIG. 5. As shown in FIG. 3, the rate of 6848 Hz is used. The inclusion of such gaps between the output data segments is a unique feature of the invention designed to reduce the susceptibility of the output to phase delay distortions when sent over transmission lines.

Figure 4E:
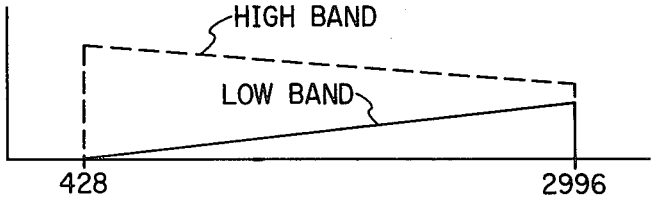

The combined output of digital-to-analog converters 30 and 31 is low pass filtered with a 3200 Hz cutoff frequency by filter 33, which can be a Butterworth filter. FIG. 4*e* illustrates the frequency domain results of the digital-to-analog conversion, intermixing and filtering. The intermixing causes the high band information and low band information to be combined. The use of the higher output clock rate 6848 Hz changes the frequency band over which the combined high band and low band components spread. As shown in FIG. 4, the 200–1400 Hz band has been transformed to a 428–2996 Hz band. The 3200 Hz low pass filter 33 smooths the output signal by interpolating between digital samples. Undesired high order spurious signals are thus eliminated.

The residual intelligibility and speech character of the encrypted output signal of the invention are reduced to an extremely low level by the combination of several processing steps. The input signal is filtered into high and low bands which are then shifted together with the high band inverted. Samples from the high and low band signal paths are randomized in time and output at a rate greater than twice the input clock rate. To reduce the susceptibility of the output signal to degradation by transmission line impairments, gaps are inserted between the randomized data segments in the output. This reduces distortion be minimizing the "smear" of signal elements into subsequent elements by delay distortion.

While the encrypted signal is very difficult to interpret to one who does not possess the key, the process of decrypting by the intended receiver is apparent to those skilled in the art, based on the encryption process. The decryption steps include sorting the scrambled signal segments back onto the appropriate high band or low band signal path and sampling at a rate which reinverts the high band components and shifts them back to the original band (1800–3000 Hz in the example).

I claim:

1. A method of encrypting an input signal, comprising:

filtering said input signal to provide a signal in a first path, having frequency components in a first band, and a signal in a second path having frequency components in a second band which is largely different from said first band;

shifting the frequency composition in at least one of said paths so that the frequency components in one of the paths lie in a band which substantially overlaps the band occupied by the frequency components of the other path, said shifting including inverting the frequency composition in at least one of said paths so that frequency components which were at higher frequencies before inversion are at lower frequencies after inversion, and components which were at lower frequencies are at higher frequencies; and intermixing time segments of signals from said first and second paths, in a rearranged, randomized time sequence, including expanding the frequency composition of the intermixed time segments so that the collection of said intermixed segments exhibits greater bandwidth.

2. The method of claim 1, wherein said shifting includes the step of sampling the filtered signal in each of said paths.

3. The method of claim 1, wherein said filtering substantially attenuates frequency components of said input signal:

in said first path, above a first sampling frequency and below one half said first sampling frequency, and, in said second path, above half of said first sampling frequency; and said shifting includes sampling the filtered signal in each of said paths at said first sampling frequency.

4. The method of claim 1, wherein said expanding includes digital-to-analog conversion at a selected rate.

5. The method of claim 1, wherein signal samples, occur in said first path at a first rate and in said second path at said same rate, and wherein said intermixed segments include said samples and said intermixing includes outputting analog data at an output data rate at least twice said first rate.

6. The method of claim 5, wherein said output data rate is greater than twice said first rate and gaps are included between intermixed signal segments.

7. The method of claim 1, wherein it is the higher of said first and second frequency bands which is shifted and inverted so as to substantially overlap the lower of said first and second bands.

8. A method of encrypting an analog input signal, comprising:

filtering said input signal to provide a signal in a first path, having frequency components in a higher frequency band, and a signal in a second path having frequency components in a lower frequency band;

deriving digital samples from the signal in the first path at a first rate and from the signal in the second path at the same rate, to invert the frequency composition in said first path so that frequency components which were at higher frequencies before inversion are at lower frequencies after inversion and components which were at lower frequencies are at higher frequencies, and to shift the higher band frequency components in said first path to lie in said lower band;

and intermixing segments of the samples on said first and second paths and converting to analog form at a rate greater than twice said first rate to provide a sequence of rearranged, randomized time segments of signals from said first and second paths, including interspersing said segments with gaps.

9. A system for encrypting an input signal, comprising:

means for filtering said input signal to provide a signal in a first path, having frequency components in a first band, and a signal in a second path having frequency components in a second band which is largely different from said first band;

means for shifting the frequency composition in at least one of said paths so that the frequency components in one of the paths lie in a band which substantially overlaps the band occupied by the frequency components of the other path, said means for shifting including means for inverting the frequency composition in at least one of said paths so that frequency components which were at higher frequencies before inversion are at lower frequencies after inversion, and components which were at lower frequencies are at higher frequencies; and means for intermixing time segments of signals from said first and second paths, in a rearranged, randomized time sequence, including means for expanding the frequency composition of the intermixed time segments so that the collection of said intermixed segments exhibits greater bandwidth.

10. The system of claim 9, wherein said means for shifting includes means for sampling the filtered signal in each of said paths.

11. The system of claim 9, wherein said means for filtering substantially attenuates frequency components of said input signal:

in said first path, above a first sampling frequency and below one half said first sampling frequency, and in said second path, above half of said first sampling frequency; and said means for shifting includes means for sampling the filtered signal in each of said paths at said first sampling frequency.

12. The system of claim 9, wherein said means for expanding includes a digital-to-analog converter.

13. The system of claim 9, including means for timing samples in said first path at a first rate and in said second path at said same rate, and wherein said means for intermixing includes means for outputting analog samples of intermixed segments at a rate at least twice said first rate.

14. The system of claim 13 wherein said outputting of samples is at a rate greater than twice said first rate and wherein said means for intermixing includes means for interspersing gaps between said intermixed signal segments.

15. The system of claim 9, wherein it is the higher of said first and second frequency bands which is shifted and inverted so as to substantially overlap the lower of said first and second bands.

16. A system for encrypting an analog input signal, comprising:

means for filtering said input signal to provide a signal in a first path, having frequency components in a higher frequency band, and a signal in a second path having frequency components in a lower frequency band;

means for deriving digital samples from the signal in the first path at a first rate and from the signal in the second path at the same rate, and for inverting the frequency composition in said first path so that frequency components which were at higher frequencies before inversion are at lower frequencies after inversion and components which were at lower frequencies are at higher frequencies, and for shifting the higher band frequency components in said first path to lie in said lower band; and means for intermixing segments of the samples from said first and second paths and converting to analog form at a rate greater than twice said first rate to provide a sequence of rearranged, randomized time segments of signals from said first and second paths, including means for interspersing said segments with gaps.

17. A method of encrypting an input signal, comprising:

deriving signal segments in digital form, each segment having multiple digitized samples and containing information from said input signal, and intermixing said segments and providing a rearranged output time sequence of said segments in analog form, the rate of said converting being greater than the minimum rate necessary to intermix said segments and convert them to analog form, so that each segment in the output analog sequence retains the information thereof from the input signal, but is separated from the next segment in the sequence by a substantial gap containing no information from the input signal, thereby to reduce the susceptibility of the output time sequence to degradation in transmission.

18. A system for encrypting an input signal, comprising:

means for deriving signal segments in digital form, each segment having multiple digitized samples and containing information from said input signal, and means for intermixing said segments and providing a rearranged output time sequence of said segments in analog form, the rate of said converting being greater than the minimum rate necessary to intermix said segments and convert them to analog form, so that each segment in the output analog sequence retains the information thereof from the input signal, but is separated from the next segment in the sequence by a substantial gap containing no information from the input signal, thereby to reduce the susceptibility of the output time sequence to degradation by transmission.

* * * * *